US009546853B2

(12) United States Patent
Morgan et al.

(10) Patent No.: US 9,546,853 B2
(45) Date of Patent: Jan. 17, 2017

(54) AIR VEHICLE WITH CONTROL SYSTEM MECHANICAL COUPLER

(71) Applicant: Raytheon Company, Waltham, MA (US)

(72) Inventors: Bruce E Morgan, Tucson, AZ (US); Stevie Alejandro, Sahuarita, AZ (US); Jerry D Robichaux, Tucson, AZ (US); Alfredo Ramos, Tucson, AZ (US); Heinz D Klemm, Sequim, WA (US); Bryan W Nickel, Tucson, AZ (US); Andrew P Douglas, Tucson, AZ (US)

(73) Assignee: Raytheon Company, Waltham, MA (US)

( * ) Notice: Subject to any disclaimer, the term of this patent is extended or adjusted under 35 U.S.C. 154(b) by 87 days.

(21) Appl. No.: 14/451,696

(22) Filed: Aug. 5, 2014

(65) Prior Publication Data

US 2016/0040967 A1 Feb. 11, 2016

(51) Int. Cl.
*F42B 10/64* (2006.01)
*F42B 15/10* (2006.01)
(Continued)

(52) U.S. Cl.
CPC ..... *F42B 10/64* (2013.01); *F42B 10/02* (2013.01); *F42B 15/01* (2013.01); *F42B 15/10* (2013.01)

(58) Field of Classification Search
CPC ..... F42B 10/24; F42B 10/18; F42B 15/10; F42B 15/01; F42B 19/01; F42B 10/64; F42B 10/02; F42B 10/04
See application file for complete search history.

(56) References Cited

U.S. PATENT DOCUMENTS 5,249,761 A * 10/1993 Schroppel ..... B64C 13/34 244/3.21
9,038,964 B2 * 5/2015 Wildman ..... B64C 9/20 244/215

(Continued)

FOREIGN PATENT DOCUMENTS

EP 1108972 A2 6/2001
GB 1341985 A 12/1973

OTHER PUBLICATIONS

International Search Report and Written Opinion from corresponding International Application No. PCT/ US2015/027190, mailed on Nov. 23, 2015.

*Primary Examiner* — Christopher P Ellis
*Assistant Examiner* — Jessica Wong
(74) *Attorney, Agent, or Firm* — Renner, Otto, Boisselle & Sklar, LLP

(57) ABSTRACT

An air vehicle, such as a munition like a guided bomb or missile, has a control system that allows control surfaces to be mechanically uncoupled from one or more actuators to allow the control surfaces to freely move (rotate) relative to a fuselage of the vehicle, for example allowing the control surfaces to "weather vane" by assuming an orientation corresponding to the direction of airflow past the air vehicle (direction of airflow relative to the air vehicle). When active positioning of the control surfaces is desired, the control surfaces may be mechanically coupled to one or more actuators that are used to position the control surfaces. The selective coupling of the actuator(s) and the control surfaces may be accomplished by selectively coupling together a sleeve that is mechanically coupled to the control surfaces, and a nut that moves along a shaft of an actuator, for example using a resilient device.

20 Claims, 10 Drawing Sheets

(51) Int. Cl.
*F42B 15/01* (2006.01)
*F42B 10/02* (2006.01)

(56) References Cited

U.S. PATENT DOCUMENTS

| | | | | |
|---|---|---|---|---|
| 2001/0030259 | A1 | 10/2001 | Hetzer et al. | |
| 2009/0101752 | A1 | 4/2009 | Mock et al. | |
| 2009/0255355 | A1* | 10/2009 | Schroeder | G05G 7/02 74/148 |
| 2012/0091255 | A1 | 4/2012 | Sweer | |

* cited by examiner

AIR VEHICLE WITH CONTROL SYSTEM MECHANICAL COUPLER

FIELD OF THE INVENTION

The invention is in the field of air vehicle control systems, such as systems for positioning control surfaces of air vehicles.

DESCRIPTION OF THE RELATED ART

Pneumatic control systems have been used on laser guided bombs. Such systems allow the control surfaces to weather vane during captive carriage and in free flight prior to laser detection, for example by being unpressurized during those periods. It would be desirable to replace pneumatic control systems with significantly lower cost, higher reliability, and higher performance alternative systems.

SUMMARY OF THE INVENTION

There are no known successful attempts to field electromechanical steering controls for laser guided bombs that allow the control surfaces to weather vane during captive carriage and free flight prior to laser detection. Missiles with electromechanical steering mechanisms that are launched from external stores stations on aircraft typically have pyrotechnically actuated fin locks. These mechanisms are expensive and reduce reliability. Pyrotechnically actuated fin locks are one-shot devices that typically cannot be disengaged to allow ground testing over full range of travel. Allowing missile control surfaces to weather vane is expected to reduce captive flight drag, compared with missiles with locked fins.

Embodiments of the invention include an electromechanical system that allows the control surfaces to weather vane to maintain the safe separation and free flight characteristics of the pneumatic systems. Doing so eliminates the need for requalification flight testing on multiple launch aircraft with multiple launch conditions, which would be expensive. For electromechanical steering control mechanisms for air launched missiles, the positioning mechanism may be isolated from external loads prior to missile launch to preclude damage to the mechanism by excessive loads, wear, or fatigue. This is especially true for missiles that are carried and launched from external weapons stores stations on aircraft. This invention allows air launched missile steering control fins to weather vane prior to launch which may improve safe separation from the aircraft, reduce captive carry drag, and reduce launch missile launch timeline by eliminating time required for control surface unlock.

According to an aspect of the invention, an air vehicle, for example a munition such as a missile or guided bomb, has electromechanically-actuated control surfaces that weather vane prior to launch.

According to another aspect of the invention, an air vehicle control system decouples the drive mechanism from the control surfaces prior to launch thereby isolating and protecting the drive mechanism from captive flight loads on the control surfaces and eliminates the need for a control surface lock. The coupling mechanism may be resettable, for example to allow ground testing of the control system.

According to yet another aspect of the invention, an air vehicle includes a fuselage; a pair of control surfaces movable relative to the fuselage; an actuator having a movable actuator shaft; and a coupler that selectively mechanically couples the actuator to the control surfaces, wherein the coupler shifts between a disengaged condition in which the control surfaces move independently of the shaft, and an engaged condition in which the movement of the shaft and the control surfaces is mechanically coupled.

According to still another aspect of the invention, an air vehicle control system includes: a pair of control surfaces; an electromagnetic actuator operatively coupled to a rotatable actuator shaft; and a coupler that selectively mechanically couples the actuator to the control surfaces, wherein the coupler shifts between a disengaged condition in which the control surfaces move independently of the shaft, and an engaged condition in which the movement of the shaft and the control surfaces is mechanically coupled. The coupler selectively couples together the actuator, and a sleeve that surrounds the actuator shaft and is mechanically coupled to the control surfaces.

According to a further aspect of the invention, a method of operating an air vehicle includes the steps of: allowing control surfaces of the air vehicle to weather vane by being passively positioned by air flow, with the control surfaces mechanically decoupled from an electromagnetic actuator of the air vehicle; after allowing the control surfaces to weather vane, mechanically coupling the electromagnetic actuator to the control surfaces; and after mechanically coupling, actively positioning the control surfaces using the electromagnetic actuator.

To the accomplishment of the foregoing and related ends, the invention comprises the features hereinafter fully described and particularly pointed out in the claims. The following description and the annexed drawings set forth in detail certain illustrative embodiments of the invention. These embodiments are indicative, however, of but a few of the various ways in which the principles of the invention may be employed. Other objects, advantages and novel features of the invention will become apparent from the following detailed description of the invention when considered in conjunction with the drawings.

BRIEF DESCRIPTION OF DRAWINGS

The annexed drawings, which are not necessarily to scale, show various aspects of the invention.

DETAILED DESCRIPTION

An air vehicle, such as a munition like a guided bomb or missile, has a control system that allows control surfaces to be mechanically uncoupled from one or more actuators to allow the control surfaces to freely move (rotate) relative to a fuselage of the vehicle, for example allowing the control surfaces to "weather vane" by assuming an orientation corresponding to the direction of airflow past the air vehicle (direction of airflow relative to the air vehicle). When active positioning of the control surfaces is desired, the control surfaces may be mechanically coupled to one or more actuators that are used to position the control surfaces. The control surfaces may be canards, with pairs of canards controlled by independent electromechanical actuators. The selective coupling of the actuator(s) and the control surfaces may be accomplished by selectively coupling together a sleeve that is mechanically coupled to the control surfaces, and a nut that moves along a shaft of an actuator, for example by use of a resilient device.

Figure 1:
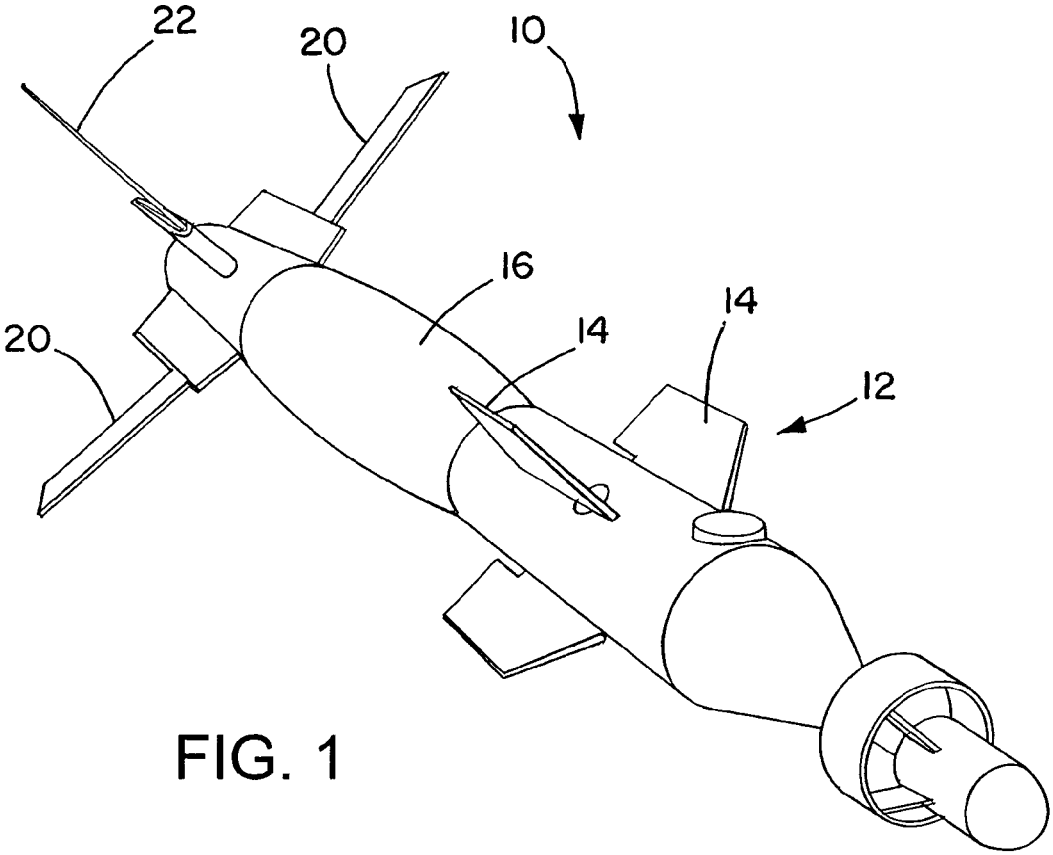
FIG. 1 is an oblique view of an air vehicle according to an embodiment of the present invention.

FIG. 1 shows an air vehicle 10 that includes a control system 12 for positioning control surfaces 14 relative to a fuselage 16 of the air vehicle 10. In the illustrated embodiment the air vehicle 10 is a munition (a guided bomb), and the control surfaces 14 are positionable canards, and are used in steering the missile during flight. The missile 10 may have other control surfaces, such as fins 20 and a rudder 22, all or parts of which may be movable. The air vehicle 10 may have a wide variety of other systems, such as a guidance system, a communication systems, one or more weapons systems (such as a warhead), and/or a propulsion system. The air vehicle may be a missile, or may be other types of aircraft, such as an unmanned aerial vehicle (UAV).

Figure 2:
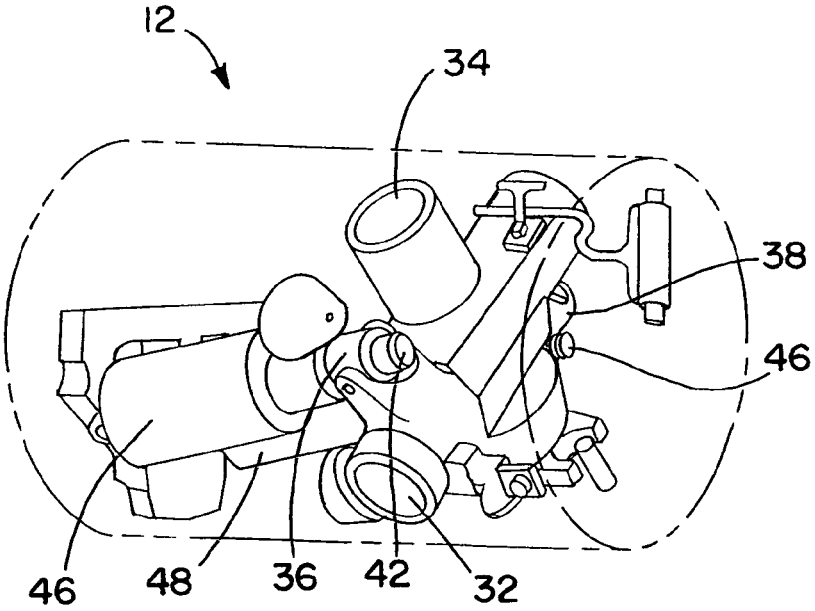
FIG. 2 is an oblique view of parts of a control system of the air vehicle of FIG. 1.

FIG. 2 shows some details of the control system 12. The control surfaces 14 (FIG. 1) include two pairs of diametrically opposed canards, with the canard pairs rotatable together relative to the fuselage 16 on separate control surface shafts 32 and 34 that cross one another, overlapping within the control system 12. The control surface shafts 32 and 34 are coupled to respective sleeves 36 and 38, which in turn enclose actuator shafts 42 and 44 emerging from (or a part of) actuators 46 and 48. The actuators 46 and 48 may be electromechanical actuators such as electric motors. In one embodiment the actuators 46 and 48 are brushless DC motors. As discussed in detail below, the control system 12 is able to be in a disengaged condition, in which the control surfaces 14 can move independently of the actuators 46 and 48, and an engaged condition, in which the control surfaces 14 are positioned relative to the fuselage 16 (FIG. 1) by the actuators 46 and 48.

Figure 3:
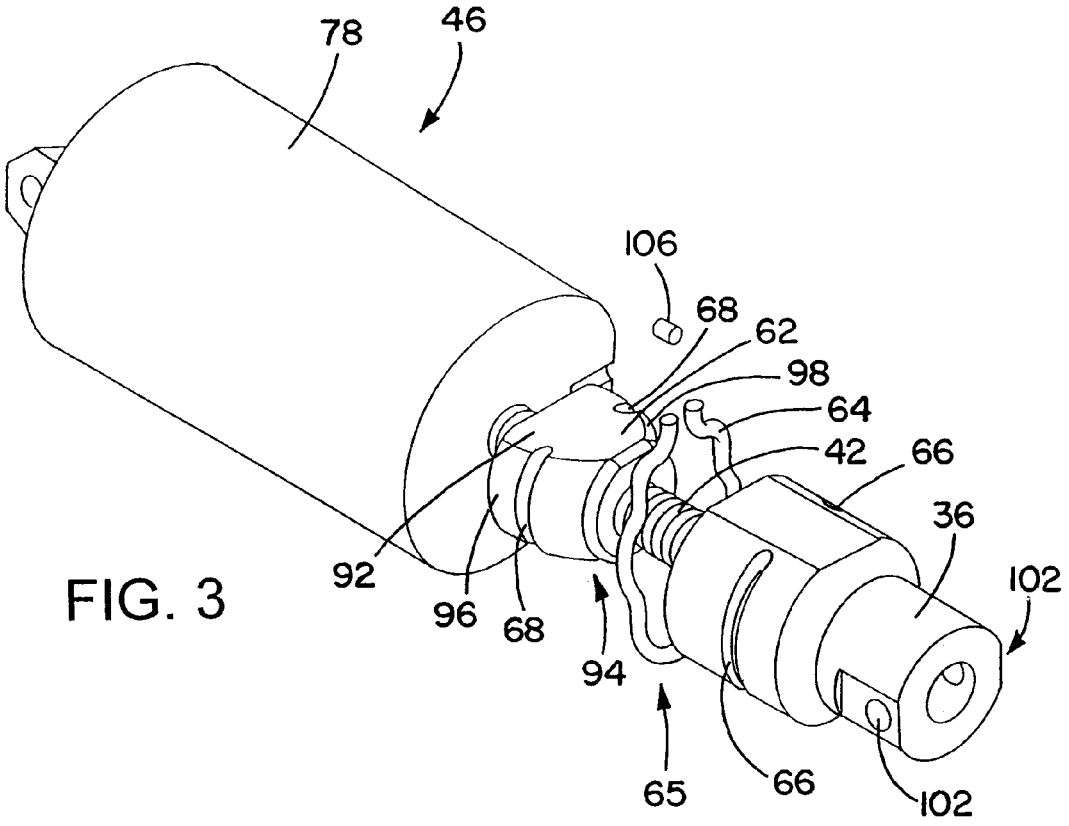
FIG. 3 is an exploded view showing some parts of the control system of FIG. 2.
Figure 4:
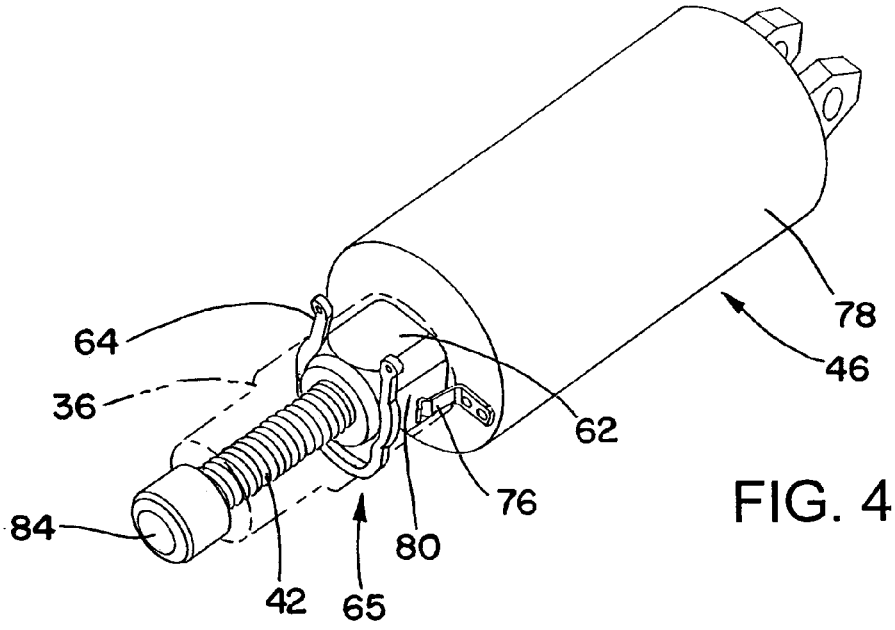
FIG. 4 is an oblique view of parts of the control system of FIG. 2.

With reference now in addition to FIGS. 3 and 4, details of the engagement of the sleeve 36 and the actuator shaft 42 are shown. The actuator shaft 42 is an externally threaded shaft, with an internally-threaded ball nut 62 threaded onto the actuator shaft 42. The actuator shaft 42 is fixedly attached to and/or integrally coupled with the actuator 46. A locking clip 64 on the sleeve 36 is used as a coupler 65 to selectively mechanically couple the sleeve 36 and the ball nut 62 together, to allow control by the actuator 46 of the position of the control surfaces 14 (FIG. 1). The clip 64 is a resilient device that is located in a pair of slots 66 in the sleeve 36. The slots 66 extend fully through parts of the material of the sleeve 36, and allow parts of the clip 64 to protrude inward into the volume enclosed by the sleeve 36. As described in greater detail below, the clip 64 can be used to mechanically couple the sleeve 36 and the ball nut 62 by engaging detents or recesses 68 in the ball nut 62.

A bracket 76 on an actuator housing 78 engages an additional detent or recess 80 on the ball nut 62, to retain the ball nut 62 against the housing 78 prior to operation of the actuator 46, when the control system is in a disengaged position. In this initial disengaged configuration the actuator 46 is disengaged from the sleeve 36, allowing the sleeve 36 to freely move relative to the actuator shaft 42, sliding in a longitudinal direction relative to the actuator shaft 42. A cap 84 at the free end of the actuator shaft 42, away from the actuator housing 78, limits the travel of the sleeve 36 along the actuator shaft 42. In addition, the cap 84 may be used to limit travel of the ball nut 62. It is also possible to incorporate travel limit features directly on the control surface shaft 32. Having the travel limit features directly on the control surface shaft 32 may be advantageous because it eliminates assembly tolerances between the actuator 46 and control surface shaft 32. Such tolerances may result in large variation of control surface travel limits. The travel limits prevent coupling from occurring when the ball nut 62 is in the "home" position (such as against the actuator housing 78.

The ball nut 62 may have a body shape that corresponds to the shape of an inside opening within the sleeve 36. In the illustrated embodiment the ball nut 62 has a pair of anti-rotation flat surfaces 92 and 94 on opposite sides of the ball nut 62. Between the flat surfaces 92 and 94 are curved surfaces 96 and 98 that have the detents 68 in them.

The sleeve 36 has a pair of holes 102 for receiving dowels or pins for coupling the sleeve 36 to the control surface shaft 32. In addition the surface of the ball nut 62 facing the actuator housing 78 may have a dowel 106 for engaging a corresponding hole in the housing 78. This feature may be used to provide a desired circumferential orientation of the ball nut 62 prior to engagement.

Figure 5:
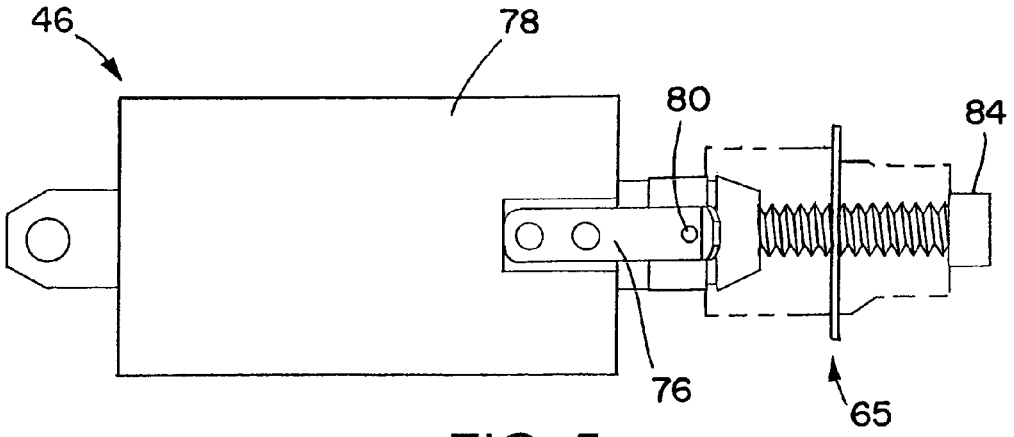
FIG. 5 is a side view of a first step in the mechanical coupling of parts of the control system of FIGS. 3 and 4.

FIGS. 5-8 show the process of the coupling together the sleeve 36 and the ball nut 62, the process of moving the coupler 65 from a disengaged condition to an engaged condition. FIG. 5 shows the initial disengaged condition. The actuator 46 is not operating, and the ball nut 62 is in the home position against the actuator housing 78, with the bracket 76 engaging the detent 80 on the ball nut 62 to hold the ball nut 62 against the actuator housing 78. When the ball nut 62 is in the home position it is out of the range of travel of the corresponding sleeve due to the travel limits in the system. In this condition the sleeve 36 is free to move longitudinally along the actuator shaft 42. This allows the control surfaces 14 (FIG. 1) to "weather vane," pointing into the airstream perceived by the air vehicle.

Figure 6:
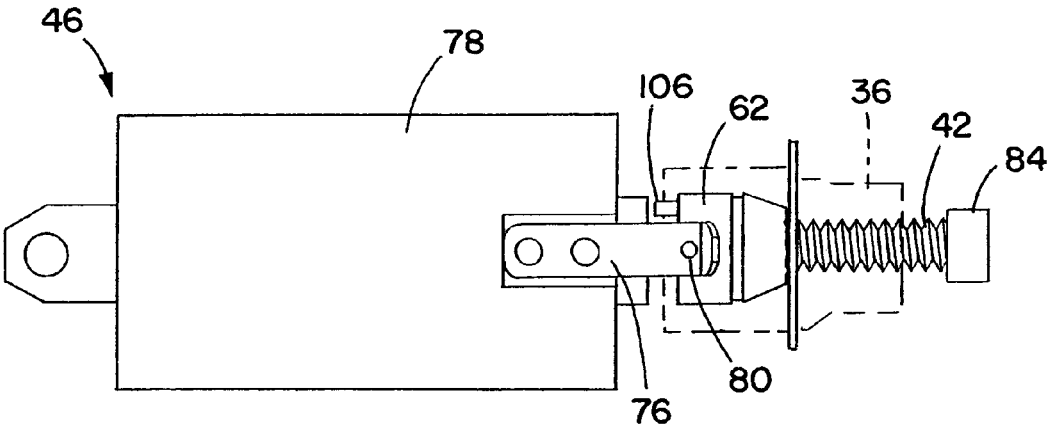
FIG. 6 is a side view of a second step in the mechanical coupling.

FIG. 6 shows part of the control system 12 (FIG. 1) after the engagement process has begun. The actuator 46 rotates the actuator shaft 42. The threaded engagement between the actuator shaft 42 and the ball nut 62 causes this rotation to produce a longitudinal force on the ball nut 62, pushing the ball nut 62 away from the actuator housing 78. This force is sufficient to overcome the engagement of the bracket 76 and the detent 80. Note that the ball nut 62 is preventing from rotating with the actuator shaft 42 by one or both of 1) the dowel engagement of the ball nut dowel 106 with the actuator housing 78; and 2) the fitting of the ball nut 62 into the sleeve 36.

Figure 7:
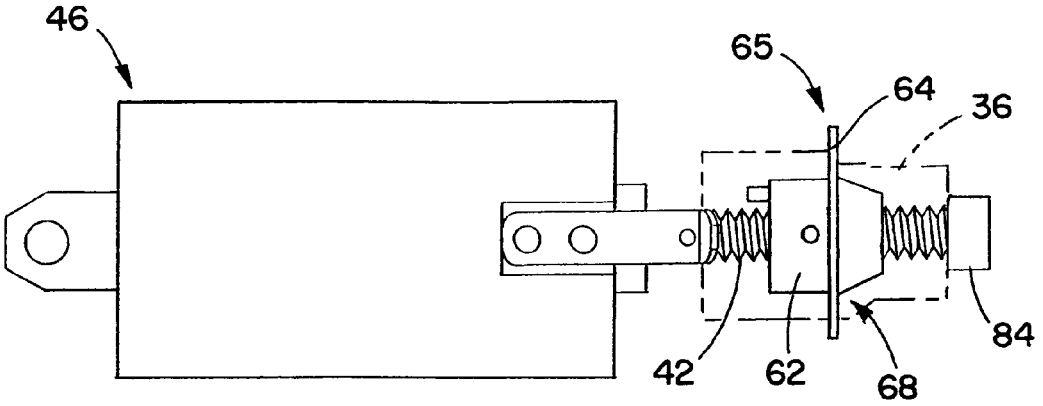
FIG. 7 is a side view of a third step in the mechanical coupling.
Figure 8:
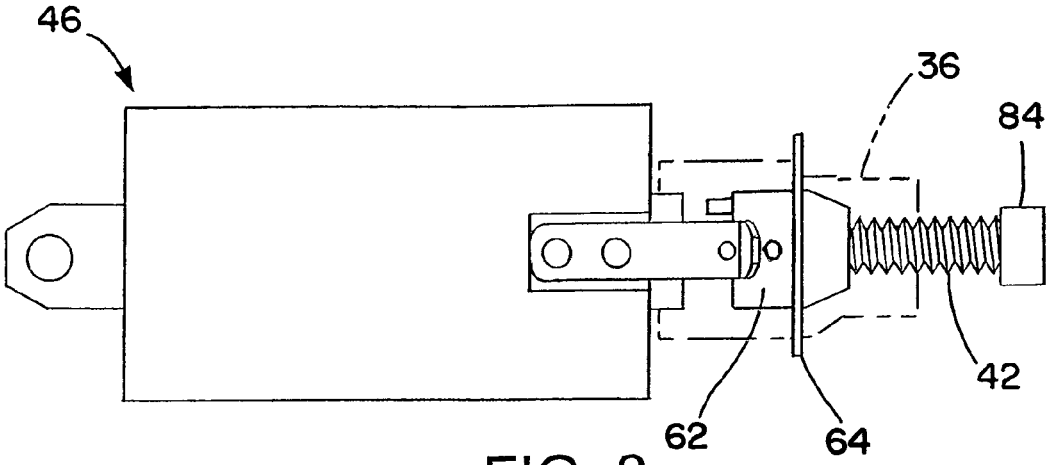
FIG. 8 is a side view of a fourth step in the mechanical coupling.

FIG. 7 shows the engagement, the mechanical coupling of the sleeve 36 and the ball nut 62. As the ball nut 62 moves longitudinally outward along the actuator shaft 46, it pushes the sleeve 36 in the same direction, or it at least restricts the travel of the sleeve 36. Eventually the sleeve 36 reaches the end of its travel, a stop such as the cap 84. The cap 84 prevents further movement of the sleeve 36 while the ball nut 62 is inserted further and further into the sleeve 36. Eventually the ball nut 62 reaches the point where it contacts the parts of the clip 64 (one embodiment of the coupler 65) that protrude inward into the interior of the sleeve 36. The ball nut 62 pushes these parts of the clip 64 outward. When the ball nut 62 reaches the point where the detents 68 are aligned with longitudinal location of the clip 64, the clip 64 resiliently snaps back in. This causes a mechanical engagement between the clip 64 and the ball nut 62, and thus a mechanical engagement between the ball nut 62 and the sleeve 36. This produces the engaged condition shown in FIG. 8, in which the ball nut 62 and the sleeve 36 move together as a single unit longitudinally up and down the actuator shaft 42. The actuator 46 is thereby mechanically coupled to the sleeve 36, meaning that positioning of the control surfaces 14 (FIG. 1) is actively controlled by the corresponding actuator 46. While in the illustrated embodiment this mechanical coupling occurs when the ball nut 62 is at or near the end of its travel, alternatively the system could be configured such that the mechanical is near a null position for the control surfaces (for example).

The actuator 44 (FIG. 2) and the sleeve 38 (FIG. 2) may be configured in a similar manner. The control system 12 (FIG. 1) may be used for example in a missile that is launched from another aircraft. The control surfaces 14 (FIG. 1) may be free to weather vane prior to launch of the missile, with the control system 12 in a disengaged condition. Prior to, during, or just after launch, the control system 12 may be engaged to allow active positioning of the control surfaces 14, for example to enable steering of the missile. This is only one possible employment of the control system 12 shown in the figures and described above.

The various parts of the control system 12 may be made of suitable materials. For example, the sleeve 36, the nut 62, and the clip 64 all may be made of hardened steel, or titanium or other suitable materials may be used as a substitute.

A control system such as the control system 12 may be used to control all sorts of control surfaces. Canards, fins, and wings are examples of surfaces that may be selectively positioned using such a system.

FIGS. 5-8 show the steps for coupling the actuator to the control surface by driving the ball nut 62 to the full extend position (its travel limit). With this method, coupling is forced at a specific time which could be immediately after safe separation or at a later time. This provides the most certainty of coupling, but requires a full hard-over input on the control surfaces, which may be undesirable. It is possible as an alternative to configure the coupling mechanism to engage at lower force and then rely on aerodynamic forces on the control surfaces to provide coupling. For example, the control surfaces may be configured to couple at 5 degrees angle of attack or even to couple at light contact. With this alternative method, control surface commands begin after safe separation. At some point, the commands should be large enough that coupling occurs. This eliminates the need for the hard-over command with the method described.

There are many variations possible in the configuration of the control system 12 and its various parts, some of which are described below with regard to various additional embodiments. Different features from the various embodiments may be combined in a single device or system, where appropriate.

Figure 9:
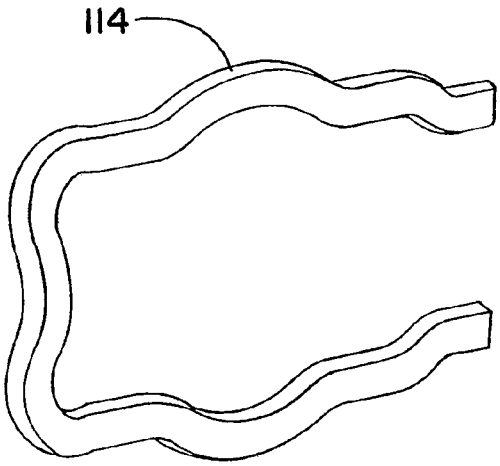
FIG. 9 is an oblique view of a clip for a first alternate embodiment control system.
Figure 10:
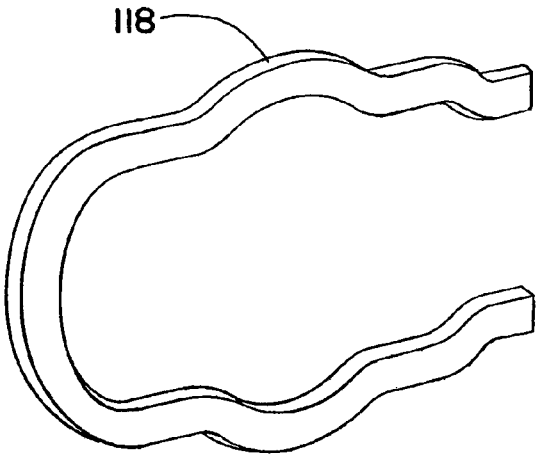
FIG. 10 is an oblique view of a clip for a second alternate embodiment control system.

FIG. 9 shows a clip 114 that may be used in place of the clip 64 (FIG. 3). The clip 114 has machined flat surfaces, so as to improve surface contact with the ball nut 62, for better coupling of the sleeve 36 and the ball nut 62. FIG. 10 shows another alternative configuration clip 118, also with a flat face.

Figure 11:
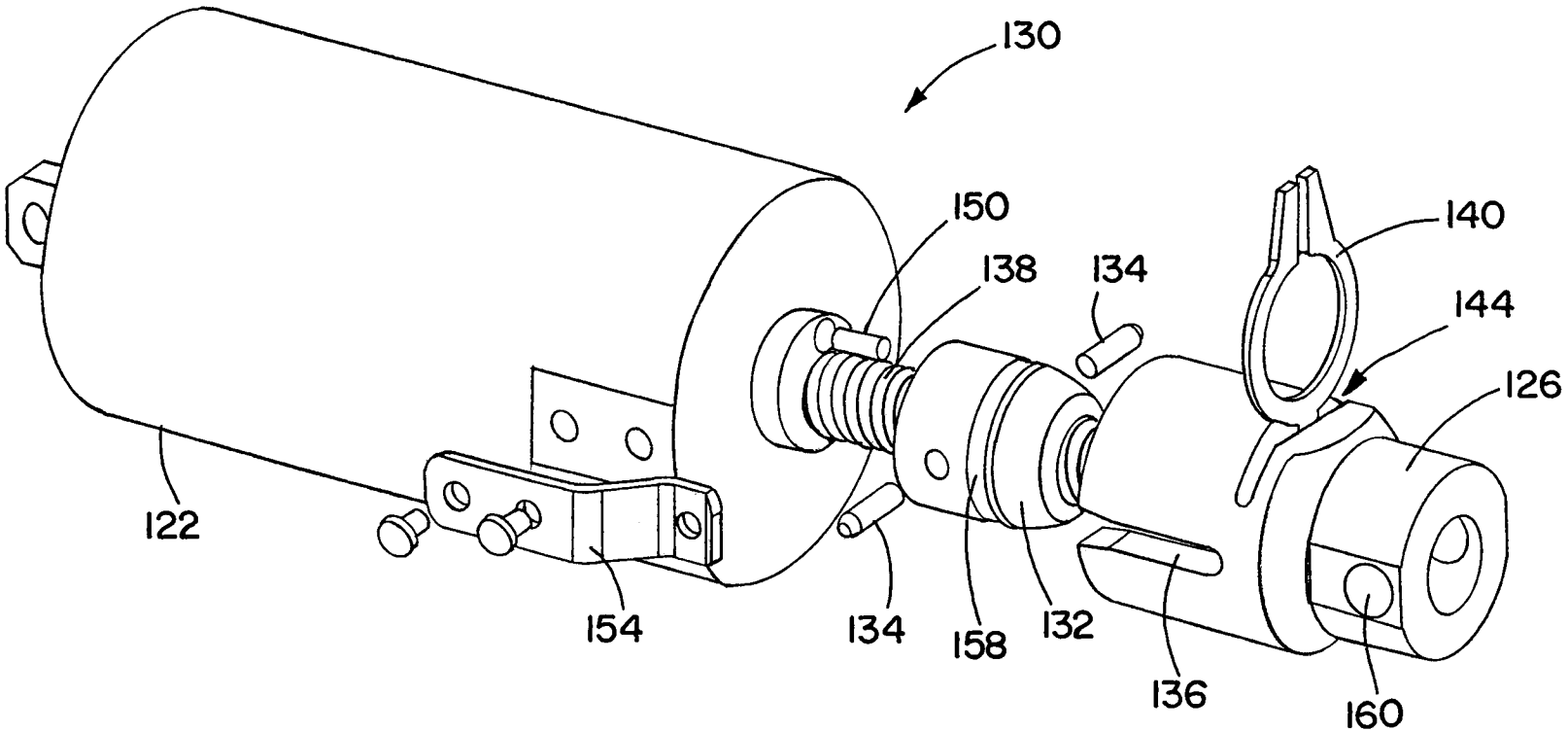
FIG. 11 is an exploded view of part of a third alternate embodiment control system.

FIG. 11 shows an alternative coupling between an actuator 122 and a sleeve 126, part of a control system 130. A ball nut 132 is generally axisymmetric, with a pair of diametrically-opposed antirotation pins 134 that engage corresponding diametrically-opposed slots 136 in the sleeve 126. The ball nut 132 is internally threaded to engage the threaded actuator shaft 138. A snap ring coupler 140 is inserted into a slot 144 in the sleeve 126, rather than fitting around a sleeve, as was the case with the locking clip 64 (FIG. 3). Other parts of the control system 130, such as an indexing pin 150 that engages the ball nut 132 and an actuator housing 152, a bracket 154 for engaging a detent 158 in the nut 132, and a hole 160 through the sleeve end for connecting the sleeve 126 to a load, have similar functions to corresponding parts of the control system 12 (FIG. 1).

Figure 12:
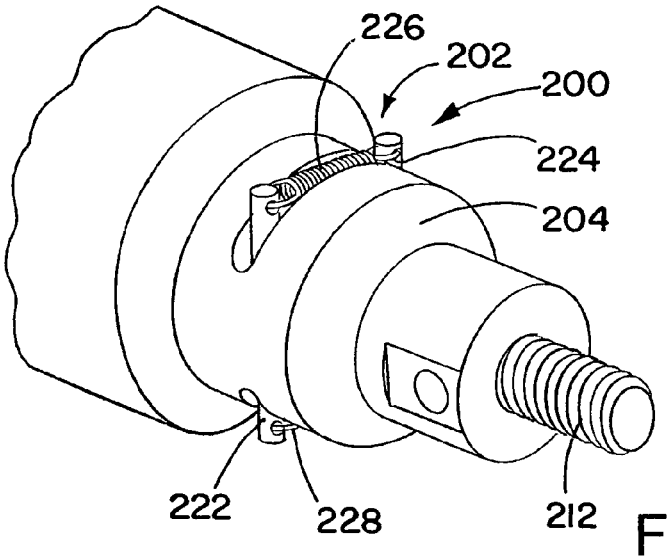
FIG. 12 is an oblique view of part of a fourth alternate embodiment control system.
Figure 13:
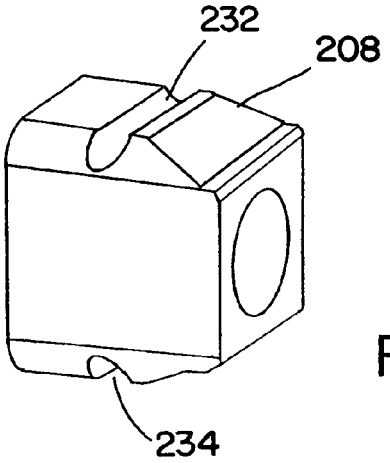
FIG. 13 is an oblique view of a nut of the system of FIG. 12.
Figure 14:
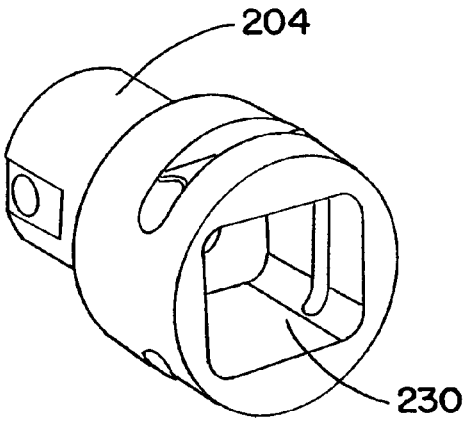
FIG. 14 is an oblique view of a sleeve of the system of FIG. 12.

FIGS. 12-14 show parts of a control system 200 with a more complicated coupler 202 for mechanically coupling together a sleeve 204 and a nut 208 that engages a threaded actuator shaft 212. The coupler 202 includes a pair of parallel, diametrically-opposed dowel pins 222 and 224 that pass through the sleeve 204, and that are engaged at opposite ends by a pair of tension springs 226 and 228 of the coupler 202. The nut 208 has a rectangular cross-sectional shape that fits into and corresponds to an interior recess 230 in at least part of the sleeve 204. The pins 222 and 224 engage detents 232 and 234 in flat surfaces on opposite sides of the nut 208, in order to accomplish mechanical coupling of the sleeve 204 and the nut 208. The springs 226 and 228 provide a resilient force that facilitates the coupling.

Figure 15:
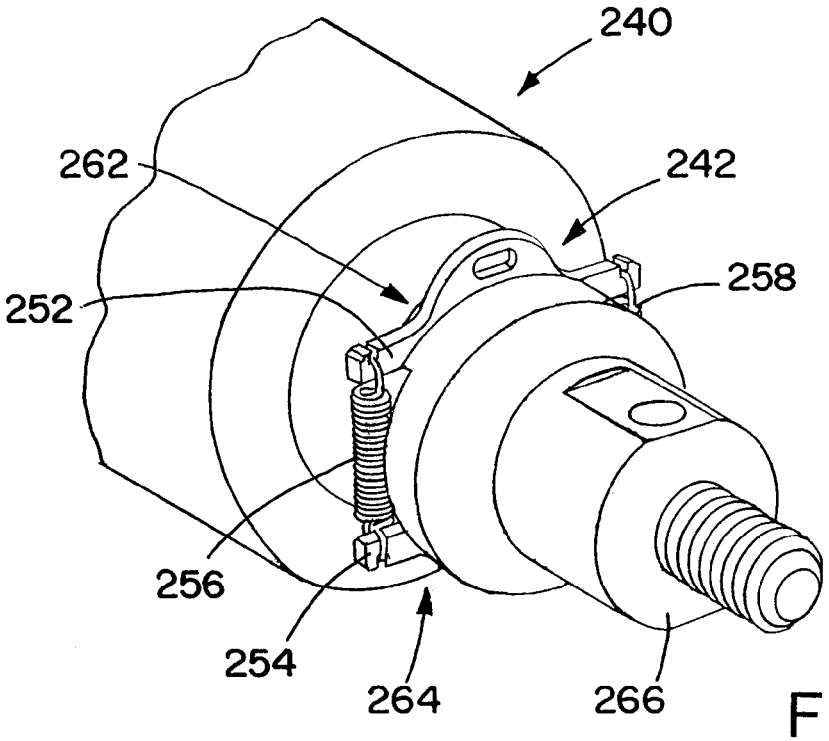
FIG. 15 is an oblique view of part of a fifth alternate embodiment control system.
Figure 16:
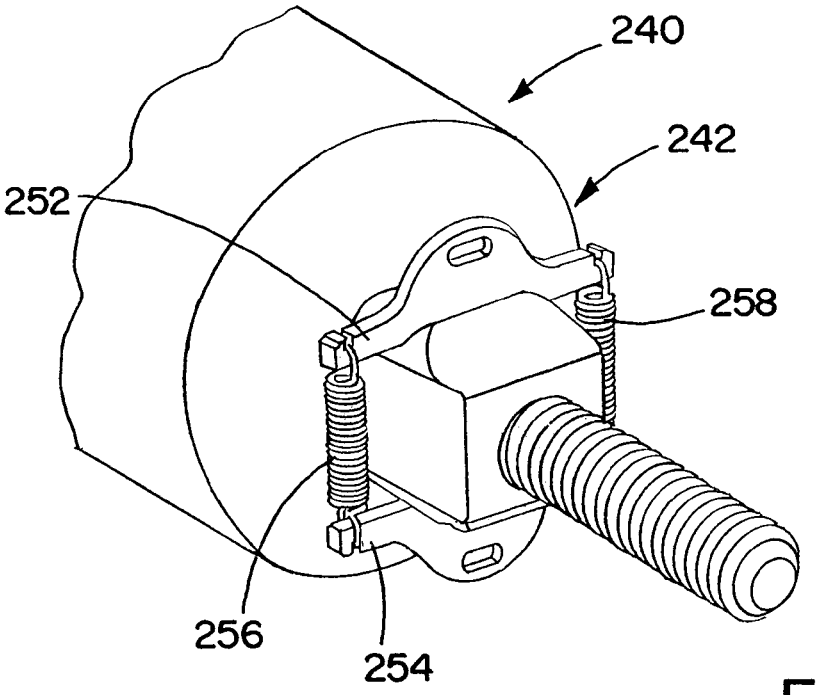
FIG. 16 is an oblique of the system of FIG. 15, showing certain internal details.

FIGS. 15 and 16 show a control system 240 that is similar to the control system 200 (FIG. 12), except that a coupler 242 has stamped lock plates 252 and 254 in place of the dowel pins 222 and 224 (FIG. 12) of the coupler 202 (FIG. 12). The lock plates 252 and 254 are coupled together by springs 256 and 258. The lock plates 252 and 254 fit into slots 262 and 264 in a sleeve 266, with the slots 262 and 264 allowing portions of the plates 252 and 254 to extend into the interior of the sleeve 266. The slots 262 and 264 may be easier to machine than the holes in the sleeve 204 (FIG. 12) for the dowel pins 222 and 224.

Figure 17:
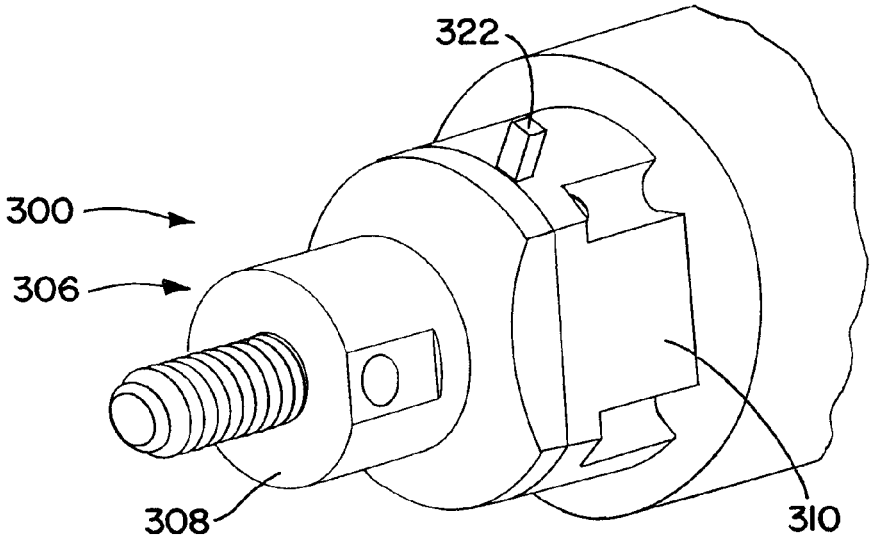
FIG. 17 is an oblique view of part of a sixth alternate embodiment control system.
Figure 18:
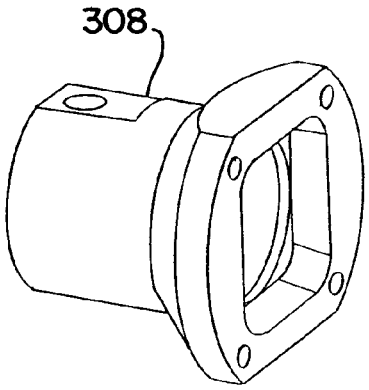
FIG. 18 is an oblique view of a sleeve of the system of FIG. 17.
Figure 19:
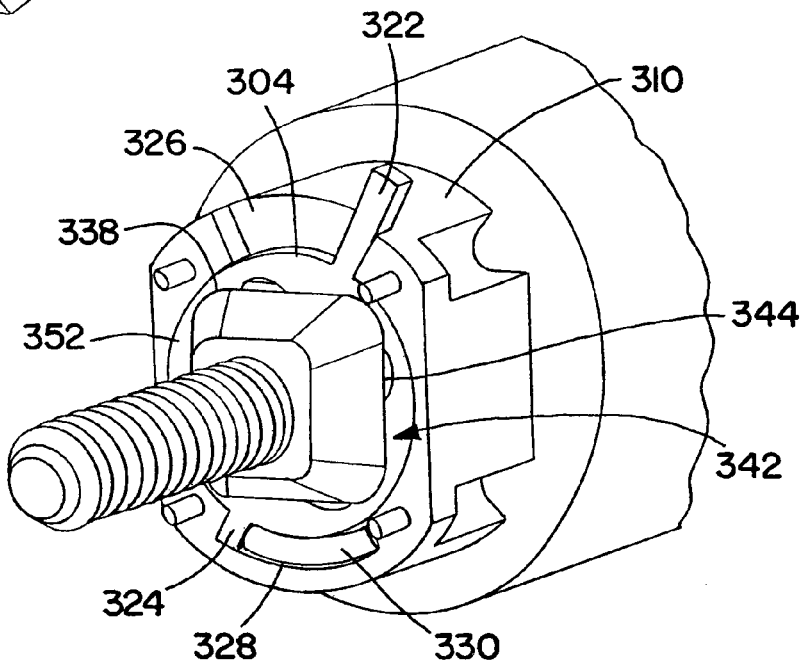
FIG. 19 is an oblique of part of the system of FIG. 17, showing certain internal details.

FIGS. 17-19 show a control system 300 which has a rotatable lock 304 that is part of a sleeve 306. The lock 304 is a stamped part that is located between a front sleeve portion 308 and a back sleeve portion 310. The lock 304 is able to rotate circumferentially to a limited extent, with radially-extending arms 322 and 324 of the lock 304 limited in their movement by stops at the ends of circumferential channels 326 and 328 in the sleeve portion 310. A compression spring 330 in the channel 328 biases the lock 304 into a position with the arms 322 and 324 at one end of the channels 326 and 328.

The lock 304 has a central opening 336 that corresponds in shape to the shape of the nose 338 of a nut 342. In the illustrated embodiment the nut 332 has a rectangular nose 338 that is able to fit through the central opening 336 of the lock 304. Behind the rectangular nose 338 the nut 342 has an offset portion 344. The offset portion 344 has a shape that is also able to fit within the central opening 336, but is circumferentially offset from the orientation of the nose 338. In operation the nut 342 engages the sleeve 306 with the nose 338 pressing against the lock plate 304. The different circumferential orientations of the nose 338 and the offset portion 344 force the nut 342 to twist to get the nose 338 through the opening 336. Once the nose 338 does get through the opening 336 it engages a front face 352 of the lock 304, as shown in FIG. 19, preventing the nose 338 from going back through the opening 336. This mechanically couples the sleeve 306 and the nut 342.

The arm 322 extends radially out of the sleeve 306 to allow a user to rotate the lock 304 manually, against the pressure provided by the compression spring 330, to release the coupling manually.

Figure 20:
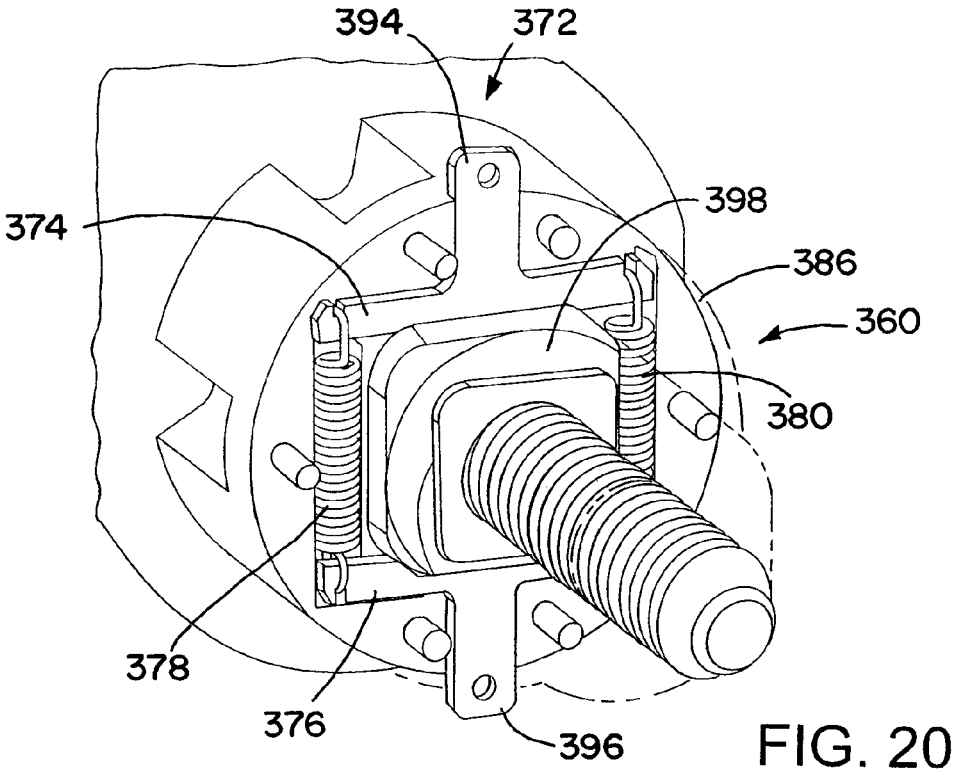
FIG. 20 is an oblique view of part of a seventh alternate embodiment control system.

FIG. 20 shows a control system 360 that combines features of the control system 240 (FIG. 15) and the control system 300 (FIG. 17). The control system 360 includes a coupler 372 that is similar to the coupler 242 (FIG. 15), with a pair of lock plates 374 and 376 that are coupled together by a pair of springs 378 and 380. However, unlike the coupler 242, the coupler 372 is located within a two-pieces sleeve 386. The lock plates 374 and 376 have respective tabs 394 and 396 that protrude out of the sleeve 386, to allow manual disengagement of the sleeve 386 from a nut 398.

Figure 21:
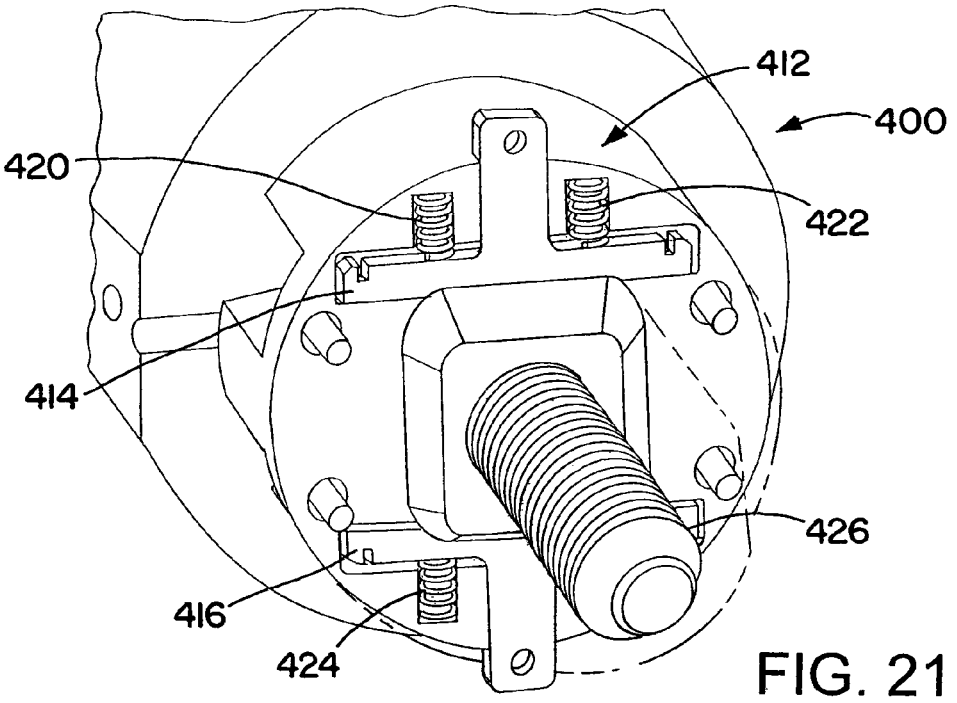
FIG. 21 is an oblique view of part of an eighth alternate embodiment control system.

FIG. 21 shows a control system 400 that is a variant on the control system 360, with a coupler 412 that has lock plates 414 and 416 that are acted on by four compression springs 420, 422, 424, and 426, in contrast to the two tension springs 378 and 380 (FIG. 20) used by the coupler 372 (FIG. 20).

Figure 22:
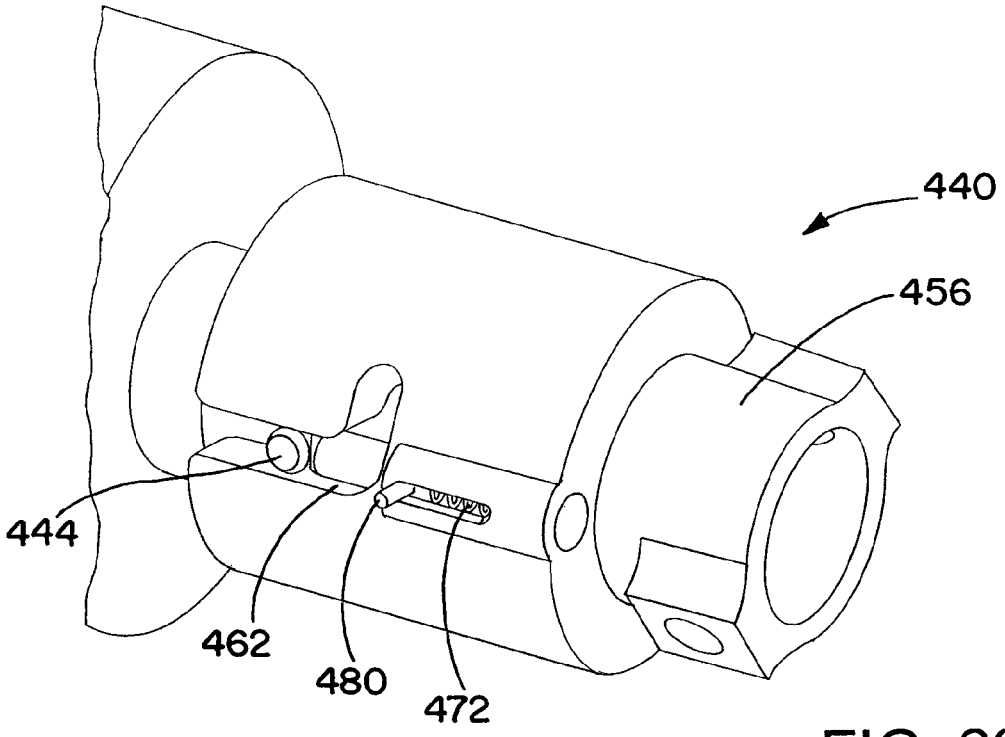
FIG. 22 is an oblique view of part of a ninth alternate embodiment control system.
Figure 23:
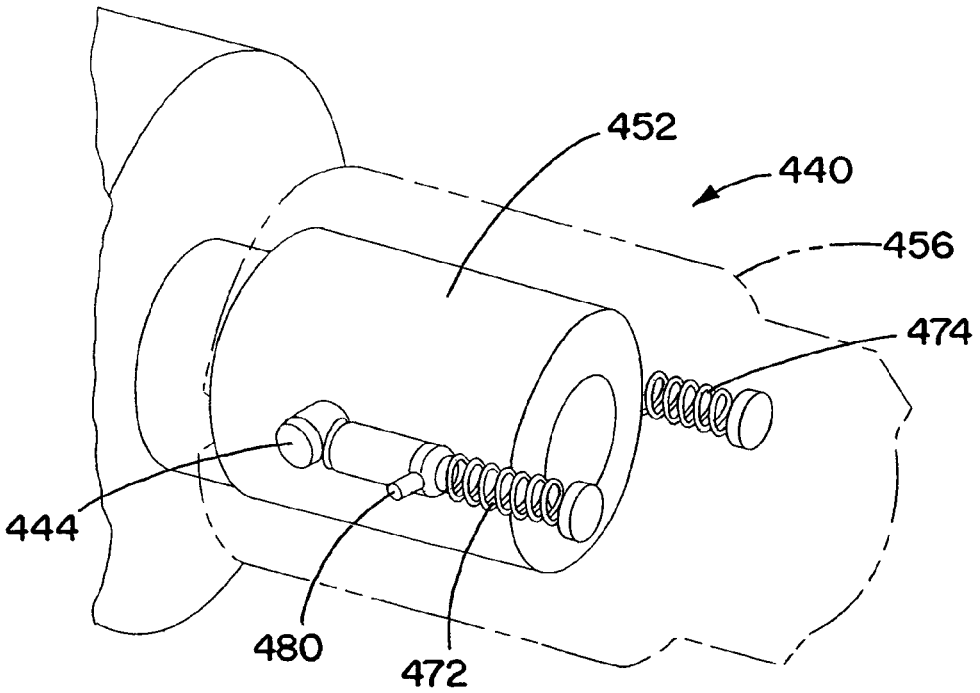
FIG. 23 is an oblique of part of the system of FIG. 22, showing certain internal details.

FIGS. 22 and 23 show a control system 440 that uses locking indexing dowel pins, such as a dowel pin 444, as a coupler to secure together a nut 452 and a sleeve 456. The sleeve 456 has a pair of diametrically-opposed L-shape slots, such as a slot 462, that allow the indexing dowel pins in, and then trapped them in place. Locking dowel pins, such as the locking pin 466, move against spring forces from the compression springs 472 and 474, as the dowel pins move along longitudinal portions of the L-shape slots. When the indexing dowel pins reach circumferential portions of the L-shape slots, rotation of the nut 452 relative to the sleeve 456 locks the nut 452 and the sleeve 456 together, with the locking pins preventing the indexing pins from returning to the longitudinal portions of the L-shape slots. The sleeve 456 may have stops, such as shown at 480, to limit the travel of the locking pins.

Although the invention has been shown and described with respect to a certain preferred embodiment or embodiments, it is obvious that equivalent alterations and modifications will occur to others skilled in the art upon the reading and understanding of this specification and the annexed drawings. In particular regard to the various functions performed by the above described elements (components, assemblies, devices, compositions, etc.), the terms (including a reference to a "means") used to describe such elements are intended to correspond, unless otherwise indicated, to any element which performs the specified function of the described element (i.e., that is functionally equivalent), even though not structurally equivalent to the disclosed structure which performs the function in the herein illustrated exemplary embodiment or embodiments of the invention. In addition, while a particular feature of the invention may have been described above with respect to only one or more of several illustrated embodiments, such feature may be combined with one or more other features of the other embodiments, as may be desired and advantageous for any given or particular application.

What is claimed is:

1. An air vehicle comprising:

a fuselage;

a pair of control surfaces movable relative to the fuselage;

an actuator having a movable actuator shaft; and a coupler that selectively mechanically couples the actuator shaft to the control surfaces, wherein the coupler is in a disengaged condition when the actuator shaft and the control surfaces are not coupled by the coupler, and wherein the coupler is in an engaged condition when the actuator shaft and the control surfaces are coupled by the coupler;

wherein the coupler is able to shift between the disengaged condition in which the control surfaces move independently of the actuator shaft such that movement of the actuator shaft does not cause movement of the control surfaces, and between the engaged condition in which the actuator shaft and the control surfaces are mechanically coupled such that movement of the actuator shaft causes movement of the control surfaces.

2. The air vehicle of claim 1, wherein the coupler selectively couples together the actuator shaft, and a sleeve that surrounds the actuator shaft and is mechanically coupled to the control surfaces.

3. The air vehicle of claim 2, wherein, when the coupler is in the disengaged condition, the sleeve moves freely longitudinally along the shaft, independent of the actuator.

4. The air vehicle of claim 2, wherein the actuator shaft is an externally-threaded shaft; and wherein a nut threadedly engages the actuator shaft to move longitudinally along the actuator shaft as the actuator shaft is turned by the actuator.

5. The air vehicle of claim 4, wherein the coupler includes a resilient device that engages both the nut and the sleeve, when the coupler is in the engaged condition.

6. The air vehicle of claim 5, wherein the coupler includes:

a pair of engagement members that protrude inward into a volume enclosed by the sleeve, wherein the engagement members engage detents on the nut when the coupler is in the engaged condition; and springs operatively coupled to the engagement members to provide a force to engage the engagement members in the detents.

7. The air vehicle of claim 6, wherein the engagement members are diametrically opposed, on opposite sides of the sleeve.

8. The air vehicle of claim 6, wherein the engagement members are pins.

9. The air vehicle of claim 6, wherein the engagement members are plates.

10. The air vehicle of claim 4, wherein the coupler moves with the sleeve when the coupler is both in the engaged condition and in the disengaged condition.

11. The air vehicle of claim 4, wherein movement of the nut presses the sleeve against a stop, to have the coupler mechanically couple the nut and the sleeve, shifting the coupler from the disengaged condition to the engaged condition.

12. The air vehicle of claim 4, wherein the nut is secured to the actuator prior to operation of the actuator to shift the coupler from the disengaged condition to the engaged condition.

13. The air vehicle of claim 12, wherein the nut is initially secured to an actuator housing of the actuator using a bracket that is fixedly coupled to the actuator housing;

wherein the bracket engages the nut to secure the nut to the actuator housing.

14. The air vehicle of claim 1, wherein the coupler is mechanically resettable from the engaged condition to the disengaged condition.

15. The air vehicle of claim 1, wherein the actuator is an electromechanical actuator.

16. The air vehicle of claim 1, wherein the air vehicle is a guided bomb or missile.

17. The air vehicle of claim 1, wherein the actuator is an electromagnetic actuator operatively coupled to the actuator shaft, the actuator shaft being rotatable; and wherein the coupler selectively couples together the actuator shaft, and a sleeve that surrounds the actuator shaft and is mechanically coupled to the control surfaces.

18. A method of operating the air vehicle of claim 1, wherein the actuator is an electromagnetic actuator, the method comprising:

allowing the control surfaces of the air vehicle to weather vane by being passively positioned by air flow, with the control surfaces mechanically decoupled from the actuator shaft of the air vehicle;

after the allowing the control surfaces to weather vane, mechanically coupling the actuator shaft to the control surfaces; and after the mechanically coupling, actively positioning the control surfaces using the electromagnetic actuator.

19. The method of claim 18, wherein the coupler is a resilient coupler, and the actuator shaft is a rotatable actuator shaft;

wherein the mechanically coupling includes using the resilient coupler to mechanically couple the rotatable actuator shaft that is mechanically coupled to the electromagnetic actuator, with a sleeve that surrounds the rotatable actuator shaft and that is mechanically coupled to the control surfaces.

20. The method of claim 18, wherein the air vehicle is a guided munition; and wherein the actively positioning of the control surfaces is used to guide the munition to a target.

* * * * *